US006909865B2

(12) United States Patent
Nagashima et al.

(10) Patent No.: US 6,909,865 B2
(45) Date of Patent: Jun. 21, 2005

(54) TONER SUPPLY CONTAINER AND PROCESS CARTRIDGE

(75) Inventors: Toshiaki Nagashima, Abiko (JP); Kazuhiko Omata, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 160 days.

(21) Appl. No.: 10/051,039

(22) Filed: Jan. 22, 2002

(65) Prior Publication Data

US 2002/0106214 A1 Aug. 8, 2002

(30) Foreign Application Priority Data

Jan. 22, 2001 (JP) ..... 2001-013361

(51) Int. Cl.[7] ..... G03G 15/08
(52) U.S. Cl. ..... 399/106; 399/262
(58) Field of Search ..... 399/103, 106, 399/119, 262; 222/DIG. 1, 541.6, 541.9; 220/270, 276, 359.1, 359.2, 359.4

(56) References Cited

U.S. PATENT DOCUMENTS

| | | | | |
|---|---|---|---|---|
| 4,931,838 A | | 6/1990 | Ban et al. | |
| 5,491,542 A | | 2/1996 | Nagashima et al. | |
| 5,655,181 A | * | 8/1997 | Chadani et al. | 399/114 |
| 5,752,131 A | * | 5/1998 | Fujiwara et al. | 399/106 |
| 5,778,282 A | | 7/1998 | Nagashima | 399/106 |
| 6,118,957 A | | 9/2000 | Fujiwara et al. | 399/103 |
| 6,118,958 A | | 9/2000 | Nagashima | 399/105 |
| 6,128,453 A | | 10/2000 | Ban et al. | 399/106 |
| 6,178,302 B1 | | 1/2001 | Nagashima et al. | 399/106 |
| 6,219,506 B1 | | 4/2001 | Morinaga et al. | 399/109 |
| 6,266,505 B1 | | 7/2001 | Ban et al. | 399/258 |
| 6,501,924 B2 | * | 12/2002 | Nagashima | 399/106 |
| 6,539,187 B2 | * | 3/2003 | De Kesel | 399/106 |

FOREIGN PATENT DOCUMENTS

| | | | | |
|---|---|---|---|---|
| JP | 59-13262 | | 1/1984 | |
| JP | 63-60164 | | 3/1988 | |
| JP | 63-60164 | | 4/1988 | |
| JP | 04155363 A | * | 5/1992 | G03G/15/08 |
| JP | 8-328369 | | 12/1996 | |
| JP | 11-72999 | | 3/1999 | |
| JP | 11-102105 | | 4/1999 | |
| JP | 11305536 A | * | 11/1999 | G03G/15/08 |

* cited by examiner

*Primary Examiner*—Robert Beatty
(74) *Attorney, Agent, or Firm*—Fitzpatrick, Cella, Harper & Scinto

(57) ABSTRACT

A toner supply container detachably mountable to an image forming apparatus, includes a main body, provided with an opening for permitting discharge of the toner, for accommodating the toner; a sealing member for unsealebly sealing the opening; wherein the opening is unsealed by tearing a part of the sealing member, wherein a pattern of welding with which the sealing member is welded on the main body of the container is inclined inwardly with respect to a tearing direction at a laterally outward end portion at a tearing starting side end portion.

30 Claims, 13 Drawing Sheets

TONER SUPPLY CONTAINER AND PROCESS CARTRIDGE

FIELD OF THE INVENTION AND RELATED ART

The present invention relates to a toner supply container for supplying toner to an image forming apparatus of an electrostatic recording type, an electrophotographic recording type or the like, such as a copying machine, a printer, or a facsimile machine, and to a process cartridge detachably mountable to the image forming apparatus.

In an image forming apparatus such as an electrostatic copying machine, printer and the like, powdery toner is used, and is supplied from a toner supply container. The toner supply container generally comprises a cylindrical, rectangular or parallelopiped shape main body made of synthetic resin material, and a toner seal member for sealing an opening of the main body is provided to permit supply of the powdery toner into a developing device.

More particularly, in an image forming apparatus using an electrophotographic image forming process, a cartridge integrally containing an electrophotographic photosensitive member and developing means actable on the electrophotographic photosensitive member is detachably mountable to the main assembly of an image forming apparatus (process cartridge type). The process cartridge type is advantageous in that maintenance operations can be performed not by a service person but by the user, and therefore, operational properties have been significantly improved. Therefore, the process cartridge type is widely used in the field of image forming apparatus.

One type of process cartridge integrally contains a photosensitive drum, a cleaner, a charger and the toner supply container. The developing means provided in the process cartridge integrally comprises a developing member for developing an electrostatic latent image formed on the photosensitive drum with the toner, and a toner supply container for supplying the toner to the developing member.

As for the toner seal member, there are two types. In one type one sheet of film is used to seal, and a sealing portion of the film is peeled off upon unsealing (easy peal type), and in the other type the film is torn. In the peeling type, a cover film and a tear tape are integrated, and upon unsealing, the tear tape is pulled to tear the cover film (tear tape type), a type in which one tearable sealing member is used. They are widely used because of their advantages that unsealing strength (resistance) can be decreased and that the width of the opening is controllable. Japanese Laid-open Patent Application Sho 59-13262, Japanese Laid-open Utility Model Application Sho 63-60164, Japanese Laid-open Patent Application Hei 8-328369, and Japanese Laid-open Patent Application Hei 11-72999, for example, discloses methods using a single tearable sealing member. Japanese Laid-open Patent Application Hei 11-102105 proposes a sealing member which is treated by a half cutting process using a laser.

The present invention provides for the improvements of these types of sealing member.

The conventional tearable film type involves a problem that balance between the film tearing performance (easy tearing) and the bonding strength of the marginal portion supporting the tearing part. For example, upon the unsealing, the film is not torn because of high unsealing strength (the pulling force required to the free end of the film), or the tearing occurs along unintended lines with a result of wider opening, upon without the toner supply control is not proper after the unsealing, or the sealing member clogs the sealing member pulling opening.

SUMMARY OF THE INVENTION

Accordingly, it is a principal object of the present invention to provide a toner supply container and a process cartridge in which a welded portion of the sealing member is prevented from peeling upon the start of the tearing of the sealing member.

It is another object of the present invention to provide a toner supply container and a process cartridge in which the sealing member can be stably torn while the withstand pressure property during the transportation is sufficient.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS (Embodiment 1)

The description will be made as to a toner seal member 1 for a toner supply container according to Embodiment 1 of the present invention.

Figure 1:
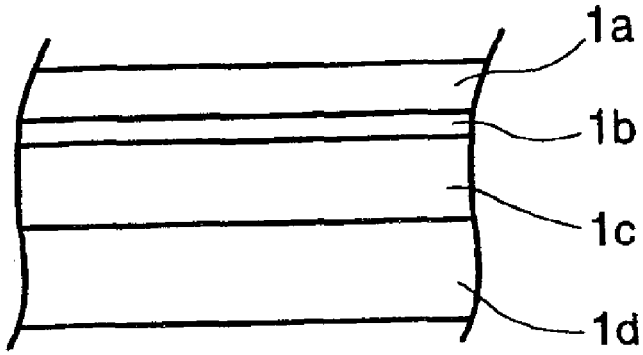
FIG. 1 is a sectional view illustrating a layer structure of a sealing member used in a toner supply container according to Embodiment 1 of the present invention.

The toner seal member 1 of this embodiment has a 4 layer structure including a surface layer, a laser blocking layer, a tearing guide layer and a sealant layer, in the order named from the top. In this embodiment, the surface layer is made of biaxial orientation polyester film having a thickness of 12 μm; the laser blocking layer is made of an aluminum foil having a thickness of 7 μm; the tearing guide layer is made of biaxial orientation polyester having a thickness of 50 μm; and the sealant layer is made of a copolymer resin material of polyethylene and ethylene and vinylacetate having a thickness of 50 μm. FIG. 1 is a sectional view of the toner seal member 1. It comprises a surface layer 1*a*, a laser blocking layer 1*b*, a tearing guide layer 1*c* and a sealant layer 1*d* in the order named from the top.

The surface layer 1*a* is required to have a heat resistive property to permit welding of the toner seal member 1 onto the main body 2 of the toner supply container, and is required to have a sufficient film strength to maintain a sealing performance as a toner seal. In addition, it is also required to have a good tearing property to permit the tearing for the unsealing. Therefore, the material is preferably biaxial orientation polyester having a thickness of 10–20 μm. preferably 12–17 μm.

The laser blocking layer 1*b* is required to have a property of not absorbing carbon dioxide laser. It is also required to have property of preventing damage to the surface layer from heat irradiation during the laser machining. Similarly to the surface layer, it is required to have an easy tearing property for the unsettling. Therefore, it is preferably made of aluminum foil having a thickness of 5–15 μm, preferably, 7–12 μm.

The tearing guide layer 1*c* is required to have a property of assuredly absorbing the carbon dioxide laser to melt and to provide a stable tearing portion. The portion adjacent to the tearing portion is required to have a sufficient strength and the tearing guide. Therefore, it is preferably made of biaxial orientation polyester having a thickness of 40–70 μm, preferably 40–60 μm.

The sealant layer 1*d* is required to assure a sufficient bonding strength relative to the other supply container (sealing property), and therefore, it is preferably made of a copolymer resin material of polyethylene and ethylene= vinylacetate having a thickness of 40–70 μm, preferably 40–60 μm.

The materials and the thicknesses of the layers of the toner seal member 1 described in the foregoing are not limiting, but may be other materials and thicknesses if the required properties are satisfied.

The tearing guide layer 1*c* of polyester is mainly melted from the sealant layer of the toner seal member 1 using a carbon dioxide laser to constitute the tearing portion 1*e*.

Figure 2:
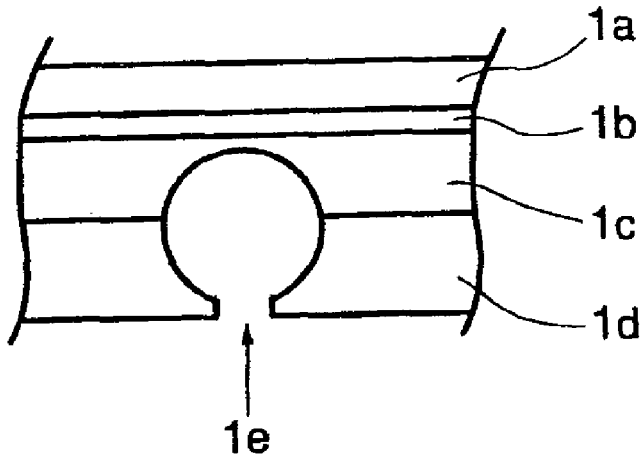
FIG. 2 is a sectional view illustrating a layer structure of the sealing member used in the toner supply container according to Embodiment 1 of the present invention.

FIG. 2 shows a toner seal sectional view for forming the tearing portion. As shown in FIG. 2, the tearing portion 1*e* is provided below the aluminum foil layer which is a laser blocking layer, more particularly, it is provided in the polyester of the tearing guide layer 1*c* melted by observing the carbon dioxide laser and in the sealant layer 1*d* which is melted by the heat irradiation.

Figure 3:
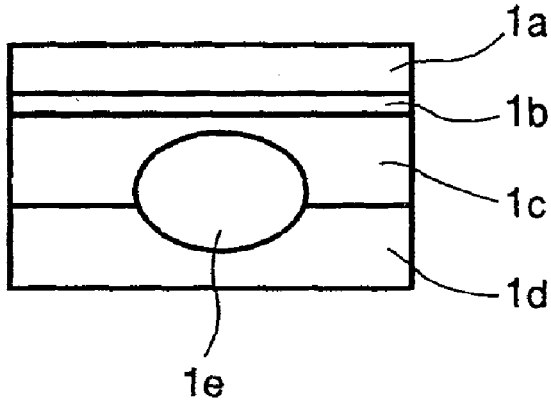
FIG. 3 is a sectional view illustrating a layer structure of the sealing member used in the toner supply container according to Embodiment 1 of the present invention.

The output of the carbon dioxide laser in this embodiment was 8W. Depending on the output (W) of the used laser and the material of the sealant, the sealant layer per se would not be completely melted with a result that a groove is not formed in the tearing portion 1*e* as shown in FIG. 2, and/or, a gap 1*e* may be formed between the polyester of the tearing guide layer 1*c* and the sealant layer 1*d* as shown in FIG. 3.

The description will be made as to the assembling of the toner seal member 1 and the main assembly 2 of the toner supply container this example.

Figure 4:
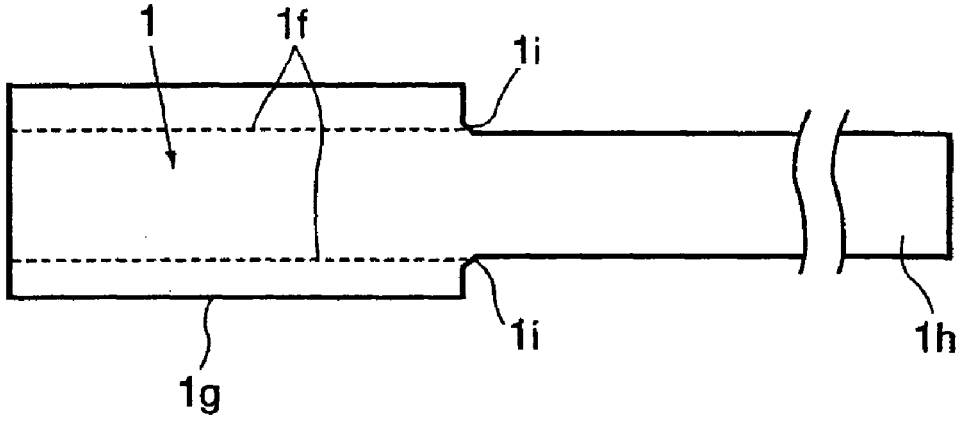
FIG. 4 is a top plan view of a sealing member used in the toner supply container according to Embodiment 1.
Figure 5:
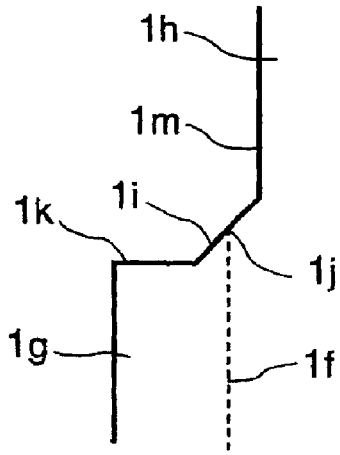
FIG. 5 is a partial enlarged view of the sealing member used in the toner supply container according to Embodiment 1 of the present invention.

FIG. 4 shows a toner seal member 1 of this embodiment. The toner seal member 1 of this embodiment comprises a sealing portion 1*g* for sealing a toner discharging opening of the main body 2 of the toner supply container (the region including a welded portion which is welded on the container along the longitudinal direction of the sealing member) and a drawing portion 1*h* which is extended from the sealing portion 1*g* and is used to pull the sealing portion 1*g* upon the sealing. The drawing portion 1*h* is not fixed, and therefore, is a free end. As shown in FIG. 5, a connecting portion 11 between the sealing portion 1*g* and the drawing portion 1*h* is inclined by 45° relative to the drawing direction, and an edge portion 1*j* of a linear tearing portion 1*e* of the tearing portion guide 1*f* ends at the connecting portion 11.

Figure 6:
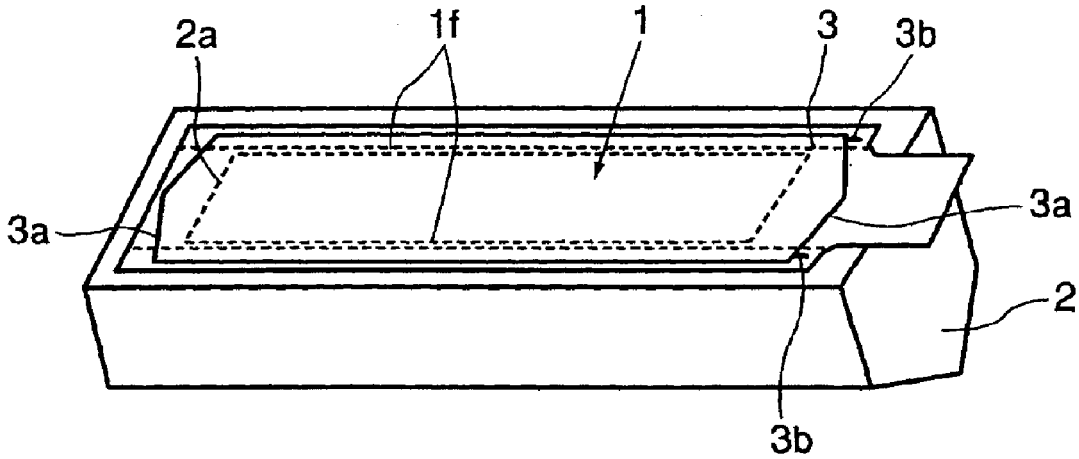
FIG. 6 is a perspective view of the toner supply container according to Embodiment 1.

FIG. 5 is a partial enlarged view of a portion shown in FIG. 4. The edge configuration is defined to permit tearing, and the inclined portion may be accurate, for example. The two tearing portions 1*f* shown in FIG. 4 are disposed such that toner discharging opening 2*a* of the main assembly 2 of the toner supply container is fully open as shown in FIG. 6 upon the unsealing operation. The connecting portion 11 is provided between a longitudinal end edge 1*k* of the sealing portion 1*g* and a side edge 1*m* of the drawing portion 1*h*.

In this embodiment, the toner seal member 1 is welded on the main body 2 of the toner supply container by heat seal. FIG. 6 shows the toner seal member 1 mounted on the main body 2 of the toner supply container.

Figure 7:
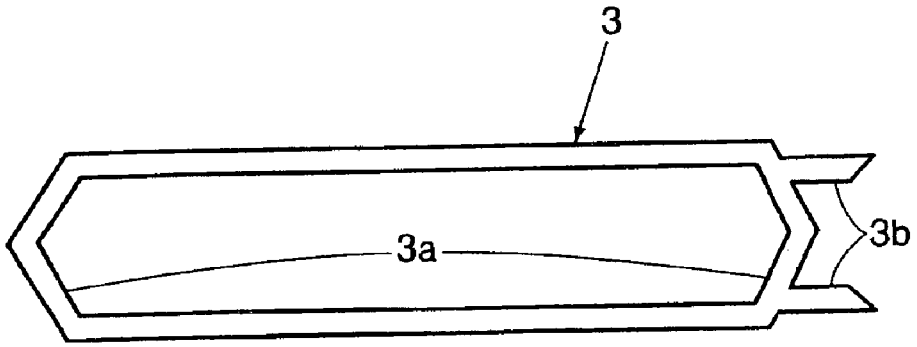
FIG. 7 is a top plan view of a seal pattern of the toner supply container of Embodiment 1.

FIG. 7 shows a seal pattern configuration, that is, a welding pattern of the welded portion of the heat seal. The seal portion 3 (welded portion) extends enclosing the toner discharging opening 2*a* on a plane including the outer edge of the toner discharging opening 2*a*. The longitudinal end 3*a* (front and rear ends) of the seal portion 3 is chevron-shaped in order to decrease the strength of the toner seal member 1 upon the unsealing. For a further assurance of the tearing of the toner seal member 1, extended seal portions 3*b* are provided continued form the longitudinal end 3*a* at the tear starting side end 3*a*, by which outer lateral sides of the tearing portion 1*f* of the toner seal member 1 are confined upon the tearing operation. The longitudinal end 3*a* of the seal portion 3 may be linear when the width is so short that influence to the unsealing strength is small.

A seal welded portion configuration of a sealing jig is in conformity with the welding pattern corresponding to the seal portion 3.

The sealing conditions are:

Pressure: 0.5 MPa (a cylinder having a diameter of 100 mm):

temperature: 150° C.:

time: 3 sec. The sealing condition are not limiting, but may be properly selected by one skilled in the art depending on the materials of the seals, the material of the main body of the container, the concealing area, the sealing width and the like.

Any material may be used for the sealing jig so long as the heat conduction is high, the process property is satisfactory, and the durability is sufficiently high. More particularly, brass, stainless steel or the like is preferable. In this embodiment, the material was brass.

Figure 8:
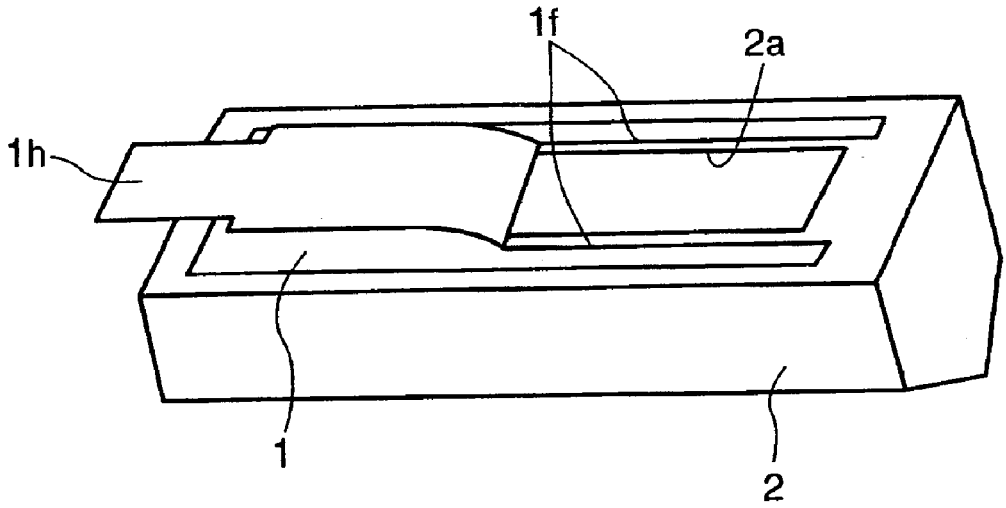
FIG. 8 is a perspective view of the toner seal in the toner supply container according to Embodiment 1, wherein the toner seal has been unsealed to a certain extent.
Figure 9:
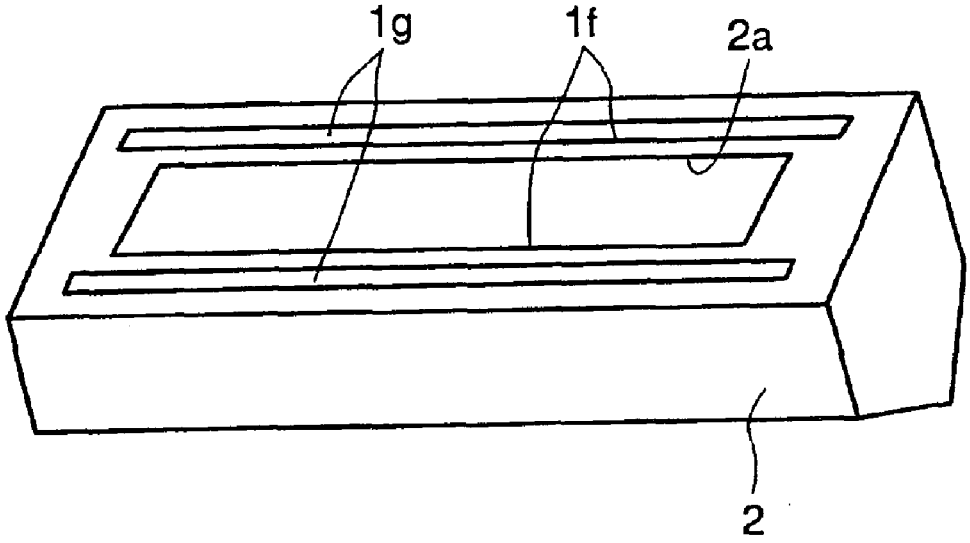
FIG. 9 is a perspective view of the toner seal in the toner supply container according to Embodiment 1, wherein the toner seal has been unsealed.

FIGS. 8, 9 show unsealing state of the toner seal member 1 of this embodiment.

The drawing portion 1*h* which is a free end of the toner seal member 1 is folded back, and is pulled, by which the toner seal member 1 is torn along the tearing portions 1*f* so that toner discharging opening 2*a* of the main body 2 of the toner supply container is opened. By doing so, the toner becomes able to be discharged.

Figure 10:
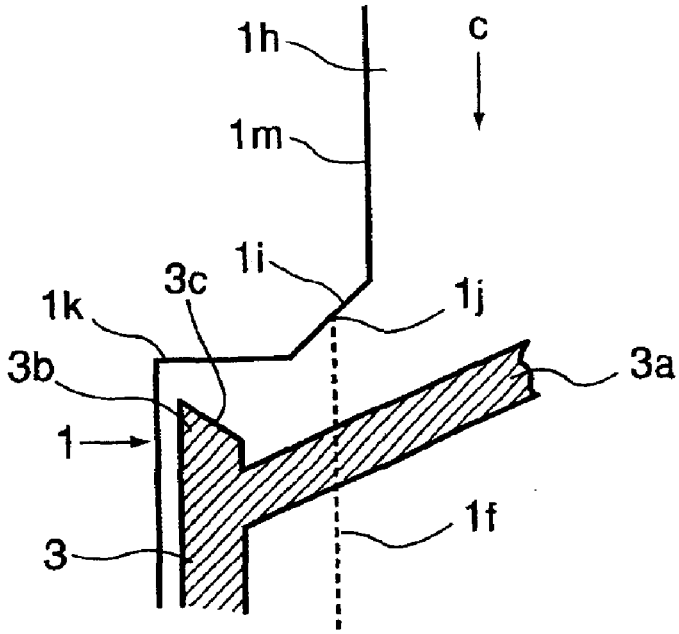
FIG. 10 is a partial enlarged view of the seal portion of the toner supply container according to Embodiment 1.

FIG. 10 is an enlarged view of an unsealing start portion of the toner seal member 1.

When the toner seal member 1 is opened, the drawing portion 1*h* of the toner seal member 1 is folded back and is pulled, by which the toner seal member 1 is torn along the tearing portion 1*f*, as described above. In order to assure the edge portions 1*j* of the toner seal member 1 to be torn, the seal portions 3*b* extended out are desirably fixed securely.

More particularly, when the extended seal portion 3*b* is more securely welded than the tearing strength of the edge portion 1*j*, the edge portion 1*j* can be torn without the welded seal portion 3*b* being peeled off. On the contrary, when the welding strength of the extended seal portion 3*b* is weaker than the tearing strength of the edge portion 1*j*, the seal portion 3*b* is peeled off without the tearing, with the result of increased unsealing strength and incapability of control of the width of the opening.

Figure 11:
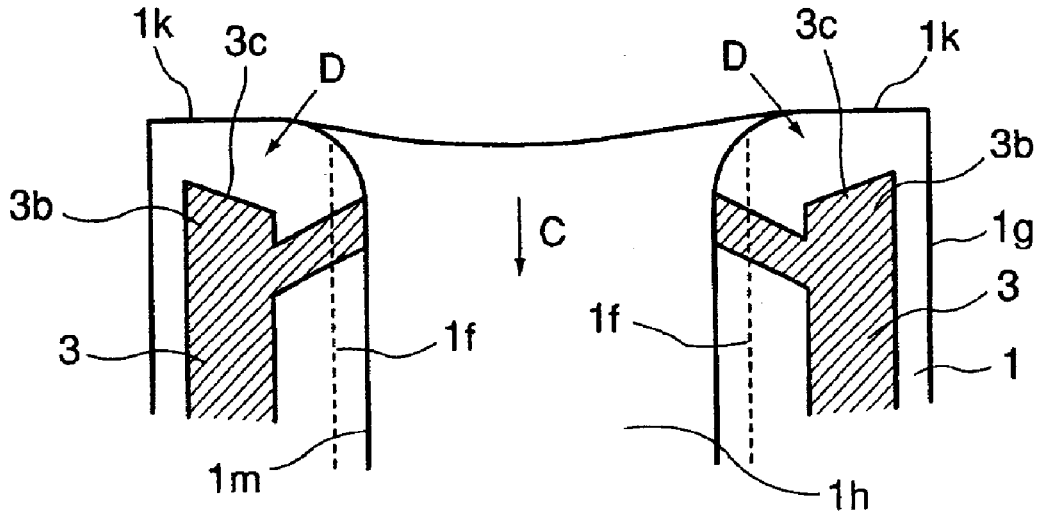
FIG. 11 is a partial enlarged view of the toner seal of the toner supply container according to Embodiment 1 in the initial stage of unsealing action.

Therefore, the bonding strength of the extended sealing member 3*b* is important. In this embodiment, there is provided a rectilinear configuration inclined inwardly with respect to the tearing direction C at the extreme end of the extended seal portion 3*b* (welded portion). More particularly, as shown in FIG. 10, at the end portion of the extended sealing member 3*b*, rectilinear configuration is provided at an angle of 45° with a message to the unsealing stretching of the toner seal member, and it is not extended beyond the toner seal member 1. FIG. 11 shows a sealing portion in which the drawing portion 1*h* is folded back at the edge 1*k* of the sealing portion 1*g* and overlaid on the sealing portion 1*g*. As shown in FIG. 11, the rectilinear configurations of the seal portions 3*b* are both inclined inwardly such that when the drawing portion 1*h* of the toner seal member 1 is folded back and pulled upon unsealing of the sealing member 1, the force D applied to the extended seal portion 3*b* in the peeling direction (raising the edge portion 1*j*) is resisted.

By this arrangement, even if a force D is produced, the inclined rectilinear configuration is effective to permit the force D to be received at a line, so that bonding strength is sufficient against the force D in the peeling direction. Accordingly, unintended peeling of the seal portion can be avoided when the toner seal member 1 is torn, thus assuring proper unsealing. In this embodiment, even if positional deviation, particularly in the longitudinal direction (the direction C or the opposite direction in FIG. 10) occurs in the assembling, the force D can be stably received at a line, and therefore, the unsealing property is not influenced, by which the latitude in the assembling is improved.

In this embodiment, the extended seal portion 3*b* has a width of 2.5 mm, and the angle of 45° of the rectilinear configuration with respect to the unsealing pulling direction C of the toner seal member 1. However, these values are not limiting, and may be changed if the above-described advantages are provided by one skilled in the art depending on the configuration of the toner seal member and the position of the seal pattern.

Figure 12:
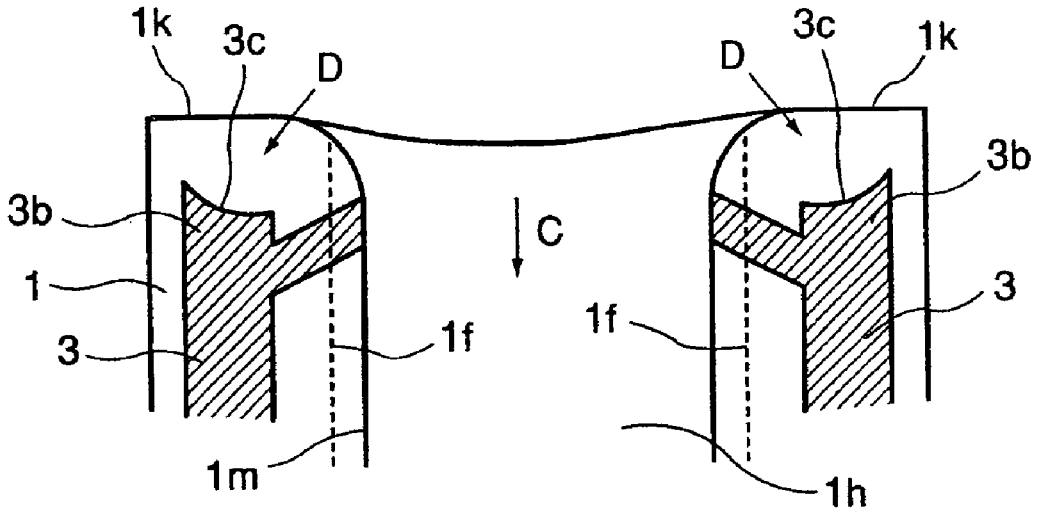
FIG. 12 is a partial enlarged view of the toner seal of the toner supply container according to Embodiment 1 in the initial stage of unsealing action.

As shown in FIG. 12, the inclined linear configuration at the end of the extended seal portion 3*b* may be arcuate, more particularly, concave toward the force D in the peeling direction to approximate the raising of the edge portion 1*j* so that force can be received at the arcuation, so that the length of the force receiving portion is increased, and therefore, the force is distributed more widely. This further improves the resistance against the peeling force. In this embodiment, the arcuate configuration is given a radius of 20 mm at the end portion. This is not limiting, and may be changed by one skilled in the art as long as the above-described advantageous effects are provided. The concavity may have a configuration other than arcuation, if it is generally concave toward the peeling force. Here, the concavity should be shallow in either case, that is, irrespective of whether the configuration is arcuate. If the concavity is deep, the intermediate portion of the seal portion 3 cannot properly withstand the peeling force at the end portions of the curve providing the concave configuration. On the contrary, the linear configuration may be convex if the convexity is very small, that is, very close to a rectilinear configuration, as long as the above-described advantageous effects can be provided.

In this embodiment, the extended seal portion 3*b* is not extended beyond the toner seal member 1, but may be extended beyond that, as long as the above-described advantageous effects can be provided. However, when the extended seal portion 3*b* extends beyond the toner seal member 1, there arises a liability that sealant layer 1*d* may be contacted to the sealing jig having the same pattern as the seal portion 3. Therefore, additional modification such as the surface of the sealing jig being coated with Teflon layer or cloth for parting property. In this sense, the seal portion 3*b* is preferably not extended beyond the toner seal member 1.

In this embodiment, the heat seal is used as the welding means. However, the welding means may be another, such as impulse sealing, ultrasonic welding or the like, as long as the above-described advantageous effects are provided.

In this embodiment, the toner seal member 1 is a sealing member machined by laser. However, this is not limiting, and the use can be made with a sealing member which is provided by uniaxial orientation process and which has a good longitudinal clearing property, or the material and the structure may be another sealing member as long as the tearing probably is good.

According to this embodiment, the heat seal is enough to provide the sealing, and therefore, the cost increases can be avoided in the assembling. In addition, the stability of the unsealing property of the toner seal can be improved with a simple structure.

Unsealing test has been carried out with the toner supply container of this embodiment, and it has been confirmed that unsealing strength is stably approx. 2–3 kg f, and tearing occurs at the intended portions. In addition, it has been confirmed that seal portion is not raised or peeled off.

(Embodiment 2)

Figure 13:
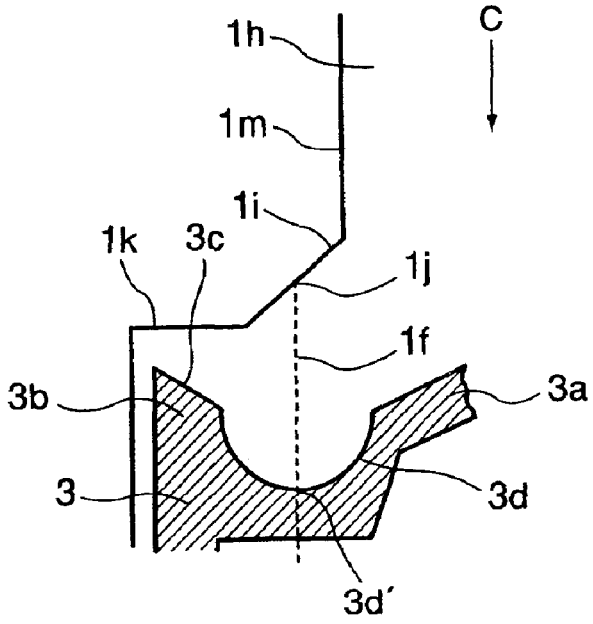
FIG. 13 is a partial enlarged view of the seal portion of the toner supply container according to Embodiment 2.

This embodiment is similar to the foregoing embodiment except that the portion of the heat seal pattern which crosses with the tearing portion 1*f* of the toner seal member 1 has a concave configuration with respect to the unsealing direction C of the toner seal member 1. FIG. 13 shows the sealing member according to this embodiment.

As shown in FIG. 13, at the longitudinal end portion 3*a* of the seal portion 3, there is provided a concave configuration 3*d* with respect to the unsealing direction C of the seal in the portion crossing with the tearing portion 1*f* of the toner seal member 1. More particularly, the configuration is arcuate, and the apex 3*d* is aligned with the tearing portion 1*f*. Here, the apex of arcuation is a contact point between the arcuation of the concave configuration is contacted with a line perpendicular the pulling direction of the toner seal member.

When the toner seal member 1 is removed, the edge portion 1*j* tends to be raised, and the peeling force D applied to the rectilinear inclined portion 1*j* of the extended seal portion 3*b* is contrasted to the tearing strength of the free end edge 1*j*. However, the bonding strength (at the line) of the seal portion 3*b* is sufficiently larger, and therefore, the edge portion 1*j* is torn, and the unsealing begins. If, at this time, delamination between layers in the toner seal member l or non-torn portion occurred, the tearing portion 1*f* is torn, because of the provision of the concave configuration of the sealing portion.

Figure 14:
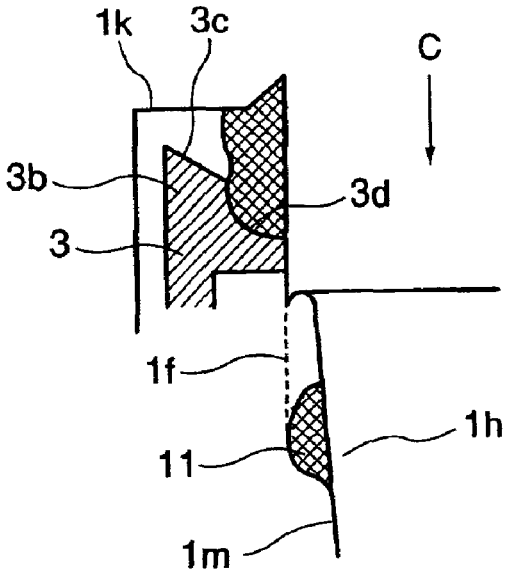
FIG. 14 is a partial enlarged view of the toner seal of the toner supply container according to Embodiment 2 in the initial stage of unsealing action.

The delamination is the phenomenon which occurs when the bonding strength in the toner seal member is not enough, or the laser machining for the tearing portion 1*e* is not enough. More particularly, the toner seal member is not torn at all the layers along the intended lines, but peeling occurs at the surface layer side, more particularly, between the surface biaxial orientation polyester layer and the second aluminum foil layer or between the aluminum foil layer and the third biaxial orientation polyester, and the peeling expands. If the peeling occurs in a large scale, the unsealing strength (resistance) increases, or the toner seal member clogs in the pulling opening. In this embodiment, as shown in FIG. 14, even if such a delamination occurs (11 in FIG. 14), the expansion of the delamination is stopped by the concave configuration 3*d* of the sealing portion, and the tearing line is guided to restore the intended line 1*f*.

In addition, even if the tearing partly fails, more particularly, if the tearing occurs inside of or outside of the intended tearing portion 1*f*, the concave configuration 3*d* of the seal portion is effective to guide the tearing line to the intended or regular line 1*f*. In other words, even if the tearing line is deviated upon the unsealing of the toner seal member, the rearing line is guided by the concave configuration 3*d* of the seal portion to the regular line 1*f*. The concave configuration 3*d* may differ if the above-described advantageous effects are provided. In this embodiment, it is arcuate, but it may also V-shaped or trapezoidal configuration.

Unsealing test has been carried out with the toner supply container of this embodiment, and it has been confirmed that unsealing strength is stably approx. 2–3 kg f, and tearing occurs at the intended portions. In addition, it has been confirmed that seal portion is not raised or peeled off.

In order to confirm the latitude in view of the variation in the manufacturing, tests were carried out in which the bonding strength between the biaxial orientation polyester layer (surface layer) and the aluminum foil layer (second layer) and/or between the aluminum foil (second layer) and the biaxial orientation polyester layer (third layer), and unsealing tests were carried out with such samples. It has been confirmed that delaminations are all limited within the recess configuration 3*d* of the seal portion, and are not expanded. The unsealing strength (resistance) has not increased. Therefore, the latitude in the assembling operation is improved.

(Embodiment 3)

In this embodiment, the toner seal member comprises a cover film 4 for sealing the toner discharging opening 2*a* and a tear tape 5 lined on the cover film 4 for tearing the cover film 4 with a width substantially equal to the toner discharging opening. This embodiment is similar to Embodiment 1 in other respects.

Figure 15:
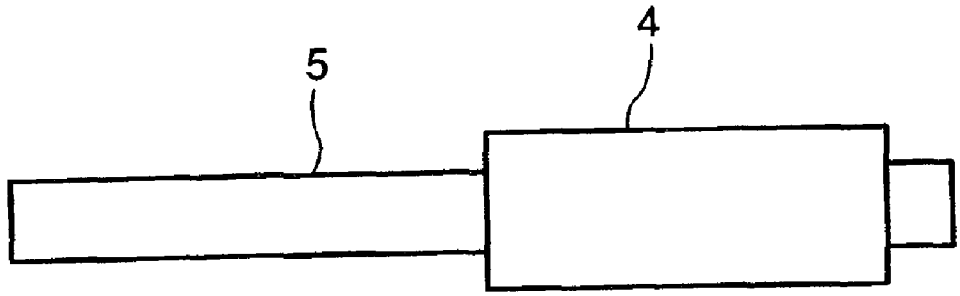
FIG. 15 is a top plan view of a sealing member used in the toner supply container according to Embodiment 3.
Figure 16:
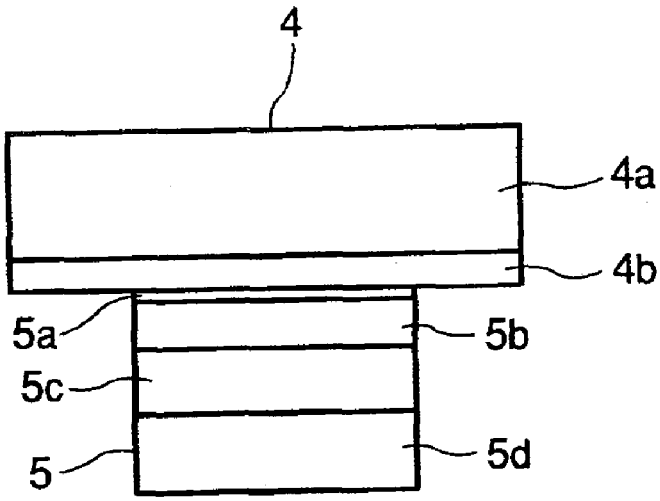
FIG. 16 is a sectional view illustrating a layer structure of the sealing member used in the toner supply container according to Embodiment 3 of the present invention.

FIGS. 15, 16 show a toner seal member 1 of this embodiment. The cover film 4 sealing the toner discharging opening 2*a* comprises a layer of expansion bubble generation polypropylene layer (140 μm (4*a*) and an EVA sealant layer (20 μm (4*b*)).

The tear tape 5 comprises a polyester layer (16 μm (5*a*)), an expansion nylon layer (25 μm (5*b*)), a low density polyethylene layer (30 μm (5*c*)) and an EVA sealant layer (40 μm (5*d*)).

The cover film 4 and the tear tape 5 are welded to each other (between 4*b* and 5*a*) into a toner seal member 1, and is welded to the main body 2 on the toner supply container by heat seal, similarly to Embodiment 1.

Figure 17:
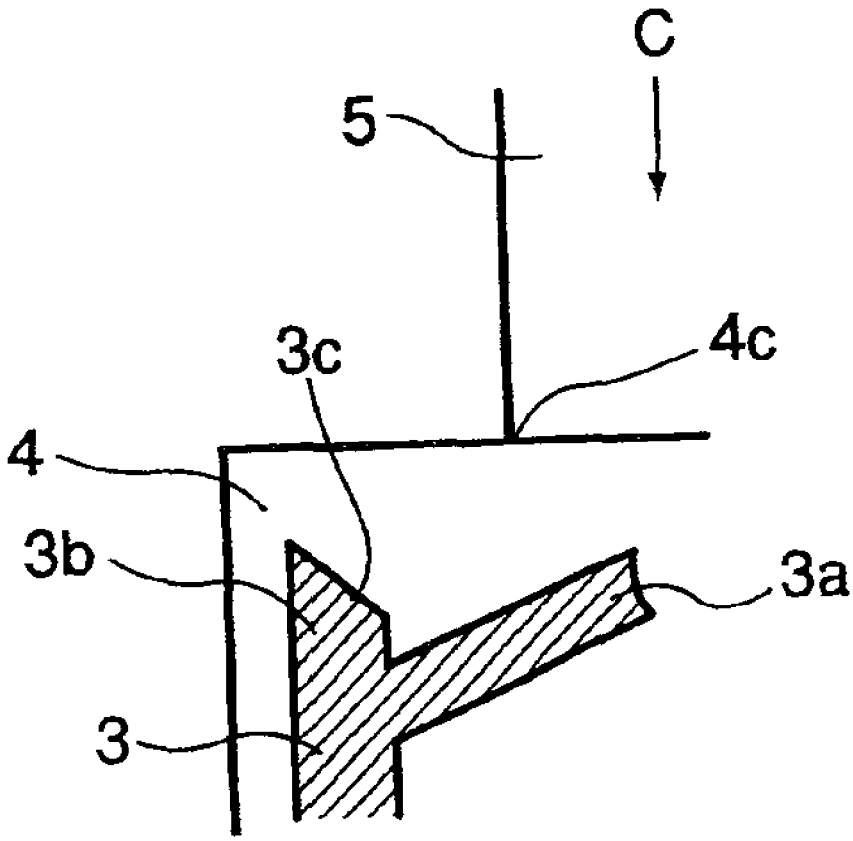
FIG. 17 is a partial enlarged view of the seal portion of the toner supply container according to Embodiment 3.

FIG. 17 is an enlarged view of a tearing start portion of the toner seal member.

Similarly to Embodiment 1, there is provided a rectilinear configuration 3*c* at the end portion of the extended seal portion 3*b*, and therefore, even though the tearing start portion 4*c* is raised, and the force is produced in the peeling direction, proper tearing can be assured. Thus, the cover film 4 can be assuredly torn. Furthermore, similarly to Embodiment 1, the rectilinear configuration 3*c* may be replaced with curve configuration such as an arcuation, and the similar advantageous effects can be provided.

As regards the assembling and manufacturing of the toner supply container, what is required is to weld the toner seal member on the main body 2 of the toner supply container. Therefore, the unsealing property stability can be accomplished with very simple assembling.

Unsealing test has been carried out with the toner supply container of this embodiment, and it has been confirmed that unsealing strength is stably approx. 2–3 kg f, and tearing occurs with the intended width (the width of the tear tape). In addition, it has been confirmed that seal portion is not raised or peeled off.

The toner seal member of this embodiment can be applied to Embodiment 2, and in such a case, the assured unsealing property can be provided, and the delamination can be suppressed, similarly to Embodiment 2.

(Embodiment 4)

Figure 18:
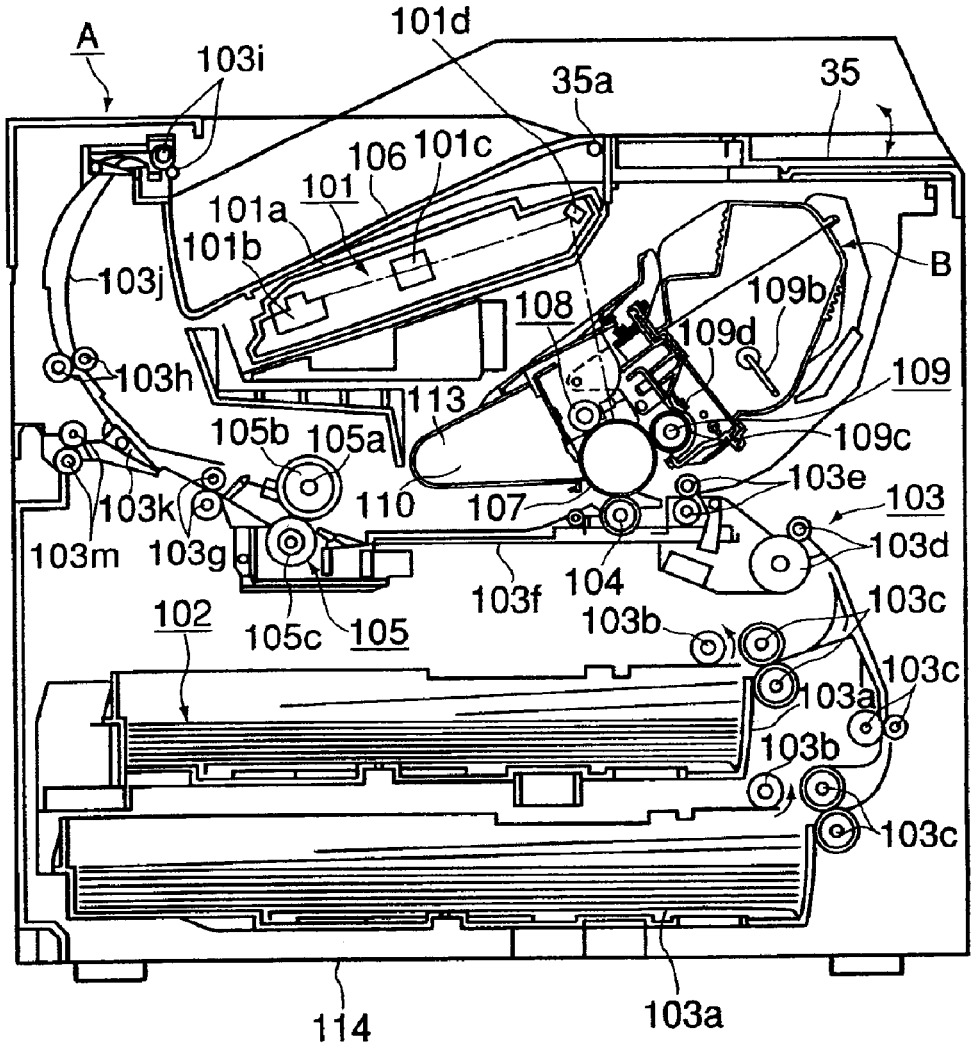
FIG. 18 is a longitudinal sectional view of a laser beam printer A.
Figure 19:
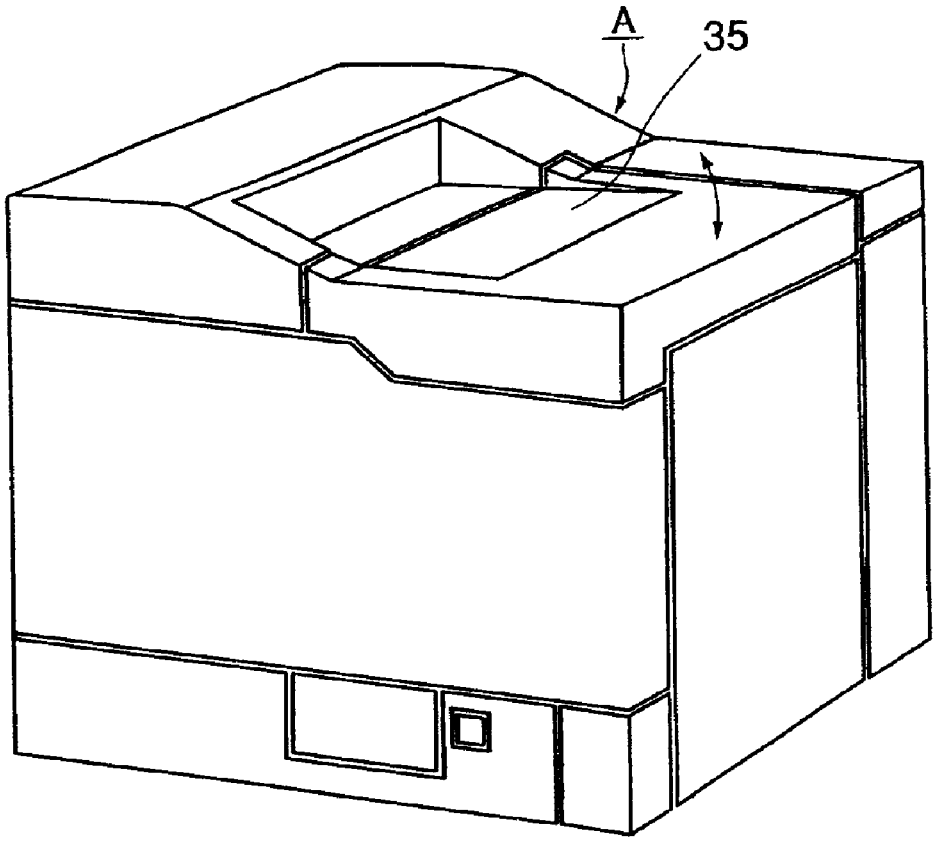
FIG. 19 is a perspective view of an outer appearance of a laser beam printer A.
Figure 20:
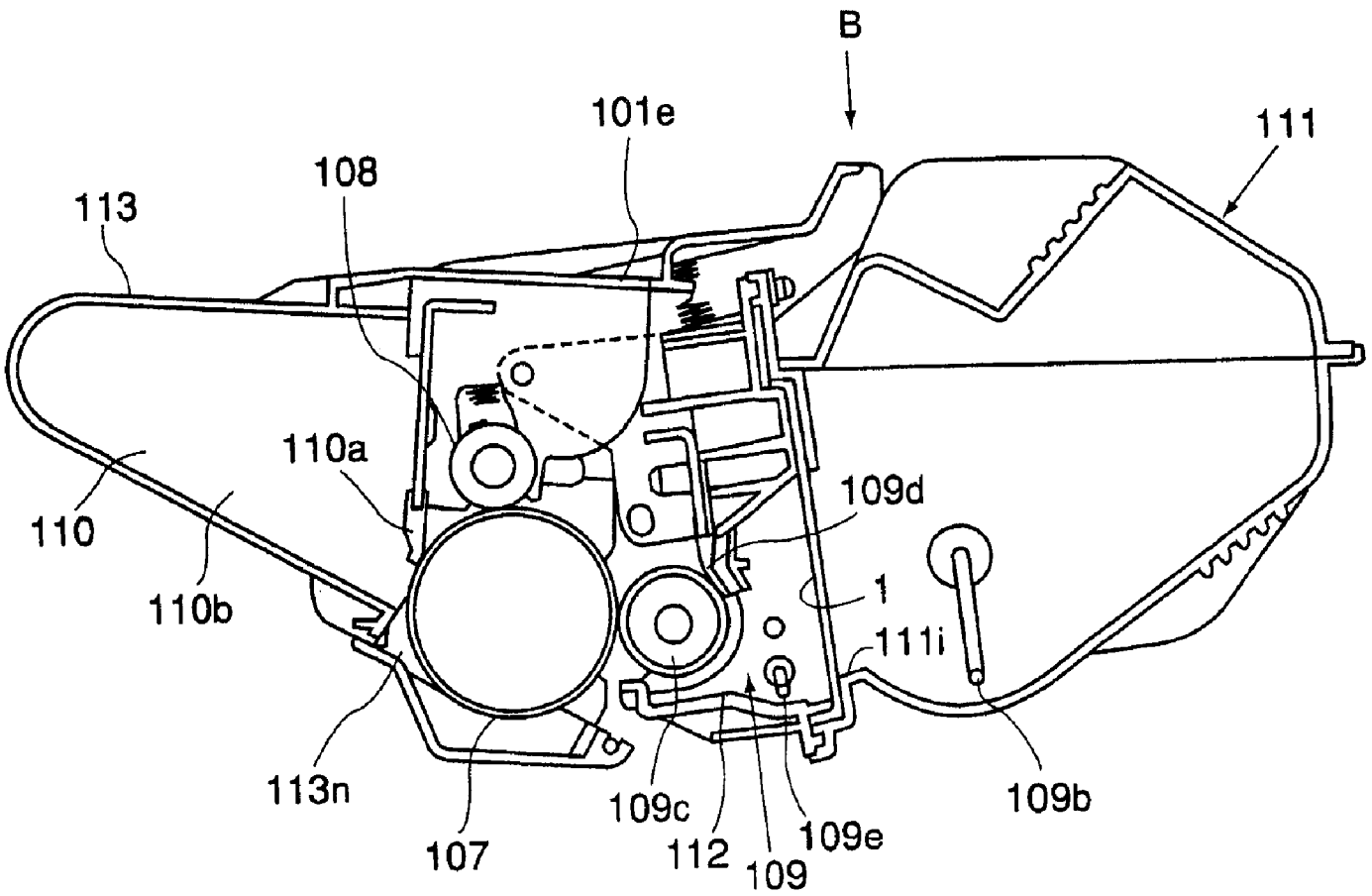
FIG. 20 is a longitudinal sectional view of a process cartridge B.

In this embodiment, the present invention, more particularly, the toner supply container of Embodiment 1 is used in a process cartridge. Referring to FIG. 20, the process cartridge of this embodiment will be described. FIG. 18 shows a general arrangement of an image forming apparatus in the form of a laser beam printer An using a process cartridge of this embodiment, and FIG. 19 shows an outer appearance. FIG. 20 is a sectional side elevation of a process cartridge B according to this embodiment of the present invention.

Referring first to FIG. 18, the laser beam printer A which is an example of the electrophotographic image forming apparatus. The laser beam printer A forms an image on a recording material 102 such as a recording paper, OHP sheet, textile or the like, through an electrophotographic image process. The laser beam printer A shown in FIG. 18 is loaded with a process cartridge B. The process cartridge B comprises an electrophotographic photosensitive member in the form of a drum (photosensitive drum 107), a charging roller 108 for electrically charging the photosensitive drum 107, and a developing means 109 for forming a toner image.

The photosensitive drum 107 is electrically charged by the charging roller 108, and is exposed to a laser beam modulated in accordance with image information and supplied from the optical means 101, so that latent image is formed corresponding to the image information on the photosensitive drum 107. The latent image is developed by the developing means 109 into a toner image. This time, the recording material 102 placed in a sheet feeding cassette 103*a* is picked up, reversed and fed in synchronism with the toner image, by a pick-up roller 103*b*, feeding rollers 103*c*, 103*d* and a pair of registration rollers 103*e*. The toner image formed on said photosensitive drum 107 is transferred onto the recording material 102 by the transferring means in the form of a transfer roller 104 supplied with a voltage. Thereafter, the recording material 102 now having the toner image transferred thereto is fed into fixing means 105 along a feeding guide 103*c*. The fixing means 105 comprises a driving roller 105*c*, and fixing roller 105*b* containing therein a heater 105*a*. The fixing means applies heat and pressure to the recording material 102 passing therethrough to fix the toner image thereon. The recording material 102 is fed by discharging rollers 103*g*, 103*h*, 1031 and, 103*h*, 1031, and is discharged to the discharging tray 106 along the reverse path 103*j*. The discharging tray 106 is provided on the top of the main assembly 114 of the laser beam printer A. By actuating a swingable flapper 103*k*, and the recording material 102 can be discharged directly by the discharging rollers 103*m* without the reverse path 103*j*. In this embodiment, the feeding means 103 is constituted by the pick-up roller 103*b*, the feeding rollers 103*c*, 103*d*, the registration rollers 103*e*, feeding guide 103*c*, the discharging rollers 103*g*, 103*h*, 1031, and discharging rollers 103*m*.

Referring to FIG. 20, the process cartridge B will be described. The process cartridge B comprises a toner frame 111 constituting the toner supply container for accommodating the toner, and a developing device frame 112 supporting the developing means 109 including a developing roller 109*c*. The toner frame 111 includes a toner discharging opening 111*i*, through which the toner is supplied into the developing device frame 112. The process cartridge B further comprises a cleaning frame 113 supporting the photosensitive drum 107, a cleaning means 110 including a cleaning blade 110*a*, and a charging roller 108. The cleaning frame 113 is coupled with the toner frame 111 and with the developing device frame 112. The process cartridge B can be detachably mountable to the main assembly 114 of the image forming apparatus by the user.

In the process cartridge B, the charging roller 108 (charging means) is contacted to the photosensitive drum 107, and is rotated by the photosensitive drum 107. During the image forming operation, the photosensitive drum 107 is rotated, and surface thereof is uniformly charged by the charging roller 108 supplied with a voltage. Then, a laser beam modulated in accordance with image information and supplied from optical means 101 provided in the laser beam printer An is projected onto the photosensitive drum 107 through an exposure opening 101*e*, so that electrostatic latent image is formed on the photosensitive drum 107. The latent image is visualized by developing the latent image by the developing means 109 with the toner. The optical means 101 include a laser diode 101*a*, a polygonal mirror 101*b*, a lens 101*c* and a reflection mirror 101*d*.

The developing means 109 supplies the toner to the developing portion toner of the photosensitive drum 107, by which the latent image formed on the photosensitive drum 107 is developed. The developing means 109 functions to supply the toner from the toner frame 111 onto the developing roller 109*c* through a toner discharging by rotation of a toner feeding member 109*b*. The developing roller 109*c* containing therein a fixed magnet is rotated, and a layer of the toner triboelectrically charged by the developing blade 109*d* is formed on the surface of the developing roller 109*c*, and the toner in the tonal layer is supplied to the developing zone of the photosensitive drum 107. The toner is transferred onto the photosensitive drum 107 responding to the latent image to form the toner visualized image.

The developing blade 109*d* functions to regulate the amount of the toner on the peripheral surface of the developing roller 109*c* and also to apply the triboelectric charge on the toner particles. Adjacent to the developing roller 109*c*, a toner stirring member 109*e* is rotatably supported to circulate the toner in the developing chamber.

The transfer roller 104 provided in the main assembly 114 of the apparatus is supplied with a voltage having a polarity which is the opposite to that of said toner image so that toner image is transferred from the photosensitive drum 107 onto the recording material 102. Thereafter, the residual toner is removed from the photosensitive drum 107 by the cleaning means 110. The cleaning means 110 scrapes the residual toner remaining on the photosensitive drum 107, by an elastic cleaning blade 110*a* contacted to the photosensitive drum 107 and collects the removed toner in a removed toner container 110*b*.

The process cartridge B is provided with an exposure opening 101*e* for projecting the light corresponding to the image information onto the photosensitive drum 107, and a transfer opening 113*n* for permitting the photosensitive drum 107 to face the recording material 102. More particularly, the exposure opening 101*e* is provided in the cleaning frame 113, and the transfer opening 113*n* is formed between the developing device frame 112 (developing portion) and the cleaning frame 113.

The toner frame 111 (toner accommodating portion) of such a process cartridge B has a toner seal member 1 which is any one of the above-described toner seal member to seal the toner discharging opening 111*i*, before the start of use of the process cartridge B. The toner frame 111 corresponds to the main body 2 of the toner supply container shown in FIG. 6, and the toner discharging opening 111*i* corresponds to the toner discharging opening 2*a*. Therefore, the detailed description of sealing structure is omitted for simplicity. As shown in FIG. 20, before the start of use of the process cartridge B, the toner seal member 1 seals the toner discharging opening 111*i* of the toner discharging to seal the toner frame 111 to prevent leakage of the toner from inside. The toner seal member 1 is folded back from the sealing portion 1*g*, and the pulling portion 1*h* is overlaid on sealing portion 1*g*, and the free end thereof is extended to outside of the process cartridge B. Upon the start of use of the process cartridge B, the toner seal member 1 sealing the toner discharging opening 111*i* is removed by pulling the pulling portion 1*h*. Then, the process cartridge B now having been unsealed is loaded into the laser beam printer A to permit developing operation.

Referring to FIG. 18, the mounting of the process cartridge B to the laser beam printer A will be described. An openable member 35 of the laser beam printer An is opened by rotation about a hinge 35*a*, guiding rails (unshown) which is provided on left and right inner walls of the main assembly 114 of apparatus and which extend downwardly toward the opening, are exposed. A cylindrical guide provided coaxially with the photosensitive drum 107 and an elongated orientation determination guide provided behind the cylindrical guide (unshown) are placed on the guiding rails, and the process cartridge is inserted until the cylindrical guide is engaged into the positioning groove of the main assembly 114 of the apparatus. When the process cartridge B is dismounted from the main assembly 114 of apparatus, the process cartridge B is drawn along the guiding rail through a reverse process.

According to this embodiment, the toner seal member 1 can be assuredly unsealed. Unsealing test has been carried out with the toner supply container of this embodiment, and it has been confirmed that unsealing strength is stably approx. 2–3 kg f, and tearing occurs at the intended portions. In addition, it has been confirmed that seal portion is not raised or peeled off.

In this embodiment, the toner supply container of Embodiment 1 is used. The same applied to the process cartridges using Embodiments 2 and 3.

COMPARISON EXAMPLE 1

Figure 21:
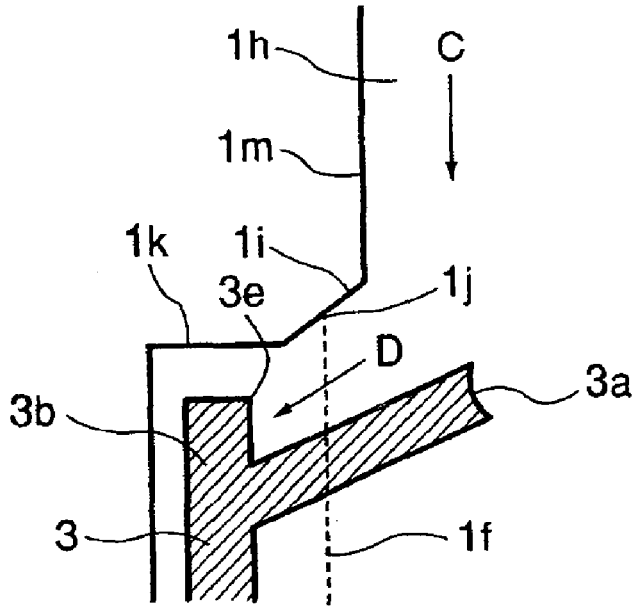
FIG. 21 is a partial enlarged view of a seal portion of a toner supply container according to a comparison example 1.

The sealing member of the comparison example is the same as the sealing member according to Embodiment 1 with the exception that the inclined rectilinear configuration portion 3*c* is not provided in the extended seal portion 3*b* of the seal portion 3. FIG. 21 shows the structure of the sealing member of the comparison example. When the toner seal member 1 is removed, the edge portion 1*j* which is the tearing start portion is raised similarly to Embodiment 1, and the force D is applied to the extended seal portion 3*b* in the peeling direction. The force is concentrated on the inner apex 3*e* at the edge of the extended portion 3*b*. Therefore, the force is not received at a line, and therefore, the bonding strength is not enough.

The unsealing tests were carried out with the toner supply container of this example. Unsealing test has been carried out with the toner supply container of this embodiment, and it has been confirmed that unsealing strength is stably approx. 2–3 kg f, and tearing occurs at the intended portions. In addition, it has been confirmed that seal portion is not raised or peeled off.

Figure 22:
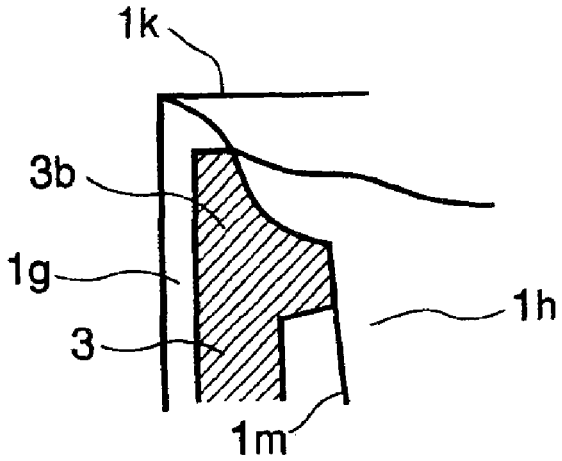
FIG. 22 is a partial enlarged view of the toner seal of the toner supply container according to comparison example 1 in the initial stage of unsealing.

However, when the bonding strength of the extended seal portion 3*b* is low due to insufficient adjustment of the contact between the container seal surface and the sealing jig because of variations in the molding of the main body 2 of the toner supply container, the toner seal is not torn at the intended tearing portions 1*f* with the result that extended seal portion 3*b* is torn at the inner apex 3*e* at the edge (FIG. 22), and the unsealing strength (resistance) increases to approx. 5–6 kg f, in some cases. Furthermore, the sealing portion 1*g* of the toner seal was completely peeled off, and the sealing member clogs in the toner seal pulling opening (unshown), in some cases.

In the foregoing, the electrophotographic image forming apparatus is an apparatus for forming an image on a recording material through an electrophotographic image formation process. Examples of electrophotographic image forming apparatuses include an electrophotographic copying machine, an electrophotographic printer (laser beam printer, LED printer or the like), a facsimile machine, and a word processor.

The process cartridge is a cartridge which contains an electrophotographic photosensitive member and at least one of charging means, developing means and cleaning means as a unit and which is detachably mountable to the main assembly of the image forming apparatus.

As described in the foregoing, according to the embodiments of the present invention, the following advantageous effects are provided. In the tearing removal of the sealing member from the toner supply container or the process cartridge, the side portions of the portion to be removed are prevented from feeling of the toner supply container or the process cartridge upon the start of tearing removal operation. Therefore, the sealing member removal is stabilized. The peeling of the surface layer portion of the sealing member is prevented from expanding, by which the removal of the sealing member is stabilized.

In the assembling and manufacturing of the toner supply container and process cartridge, the number of manufacturing steps does not increase, and stability of the unsealing property of the toner seal is accomplished with very simple assembling.

While the invention has been described with reference to the structures disclosed herein, it is not confined to the details set forth and this application is intended to cover such modifications or changes as may come within the purpose of the improvements or the scope of the following claims.

What is claimed is:

1. A toner supply container detachably mountable to an image forming apparatus, said toner supply container comprising:

a container body configured to contain toner, said container body having an opening for permitting discharge of the toner; and a sealing member configured and positioned to seal the opening, said sealing member comprising:

a welded portion which is welded to said container body; and a tearing portion which is torn upon unsealing of the opening in a tearing direction along a tearing line, wherein said welded portion has an inclined portion which is provided adjacent an end portion at which tearing of said tearing portion starts and which is disposed laterally outside of the tearing line, and wherein said inclined portion is inclined as it extends toward the tearing line in the tearing direction.

2. A toner supply container according to claim 1, wherein said inclined portion is rectilinearly inclined.

3. A toner supply container according to claim 1, wherein said inclined portion is inclined with a curvature.

4. A toner supply container according to claim 1, wherein said welded portion is provided in the region where the tearing of said tearing portion starts with a concave portion which is concave toward a downstream direction with respect to the tearing direction.

5. A toner supply container according to claim 1, wherein said sealing member further comprises an extension which extends from a tearing-starting side of said welded portion and which is folded back and extends to an end thereof, wherein the end of said extension is provided with a pulling portion.

6. A toner supply container according to claim 1, wherein said sealing member is made of plastic resin film, and said tearing portion is formed by laser irradiation on said plastic resin film.

7. A toner supply container according to claim 1, wherein said sealing member includes a cover film welded to said container body so as to seal the opening, and a tear tape configured and positioned to tear the cover film, wherein said cover film comprises said welded portion and wherein said tearing portion comprises said tear tape.

8. A process cartridge detachably mountable to an image forming apparatus, said process cartridge comprising:

a developing container which is effective to develop a latent image on a photosensitive member with toner;

a toner container configured to accommodate the toner;

an opening, formed in said toner container, and configured and positioned to supply the toner into said developing container; and a sealing member configured and positioned to seal the opening, said sealing member comprising:

a welded portion which is welded to said toner container; and a tearing portion which is torn in a tearing direction along a tearing line upon unsealing of the opening, wherein said welded portion has an inclined portion which is provided adjacent an end portion at which tearing of said tearing portion starts and which is disposed laterally outside of the tearing line, and wherein said inclined portion is inclined as it extends toward the tearing line in the tearing direction.

9. A process cartridge according to claim 8, wherein said inclined portion is rectilinearly inclined.

10. A process cartridge according to claim 8, wherein said inclined portion is inclined with a curvature.

11. A process cartridge according to claim 8, wherein said welded portion is provided in the region where the tearing of said tearing portion starts with a concave portion which is concave toward the downstream direction with respect to the tearing direction.

12. A process cartridge according to claim 8, wherein said sealing member is made of resin film, and said tearing portion is formed by laser irradiation on said resin film.

13. A process cartridge according to claim 8, wherein said sealing member includes a cover film welded to said toner container so as to seal the opening, and a tear tape configured and positioned to tear said cover film, wherein said cover film comprises said welded portion, and wherein said tearing portion comprises said tear tape.

14. A toner supply container according to claim 1, wherein said tearing portion is provided at each of lateral sides of the opening, and said inclined portion is provided at each of positions outside of said tearing portion in the width direction thereof.

15. A process cartridge according to claim 8, wherein said tearing portion is provided at each of lateral sides of the opening, and said inclined portion is provided at each of positions outside of said tearing portion in the width direction thereof.

16. A process cartridge according to claim 8, wherein said sealing member further comprises an extension which extends from a tearing-starting side of said welded portion and which is folded back and extends to an end thereof, wherein the end of said extension is provided with a pulling portion.

17. A toner supply container detachably mountable to an image forming apparatus, comprising:

a container body configured to contain toner, said container body being provided with an opening for permitting discharging of the toner; and a resin film configured and positioned to seal the opening, said resin film including:

a welded portion which is welded to said container body and which includes lateral sides; and two tearing portions, each provided on one of said lateral sides of said welded portion, wherein said tearing portions are torn in a tearing direction to unseal the opening, wherein said welded portion includes:

a surrounding portion configured and positioned to surround the opening; and an extension extending at a position laterally outside of one of said tearing portions from said surrounding portion in an upstream direction with respect to the tearing direction in which said tearing portions are torn, wherein said extension has an inclined portion at a leading end portion of said extension with respect to a direction in which said extension extends, and wherein said inclined portion is inclined as it extends toward one of said tearing portions in the tearing direction.

18. A toner supply container according to claim 17, wherein said inclined potion is rectilinearly inclined.

19. A toner supply container according to claim 17, wherein said inclined portion is inclined with a curvature.

20. A toner supply container according to claim 17, wherein said welded portion is provided in the region where the tearing of said tearing portions starts with a concave portion which is concave toward a downstream direction with respect to the tearing direction.

21. A toner supply container according to claim 17, wherein said resin film further comprises a portion which extends from a tearing-starting side of said welded portion and which is folded back and extends to an end thereof, wherein the end of said portion which extends from the tearing-starting side of said welded portion is provided with a pulling portion.

22. A toner supply container according to claim 17, wherein said tearing portions are provided by using laser irradiation.

23. A toner supply container according to claim 17, further comprising a tear tape configured and positioned to remove said resin film, wherein said tearing portions comprise said tear tape.

24. A toner supply container detachably mountable to an image forming apparatus, comprising:

a container body configured and positioned to contain toner, said container body being provided with an opening for permitting discharging of the toner; and a tearable resin film configured and positioned to seal the opening, said resin film including a welded portion which is welded to said container body, wherein said welded portion includes:

a portion to be removed from said container body by tearing of said resin film in a tearing direction;

a portion not to be removed from said container body; and an auxiliary welded portion configured and positioned to suppress peeling of said portion of said welded portion not to be removed from said container body, wherein said auxiliary welded portion is provided at positions laterally outside of said portion to be removed from said container body, wherein said auxiliary welded portion has an inclined portion at a leading end portion thereof with respect to a direction in which said auxiliary welded portion extends, and wherein said inclined portion is inclined as it extends toward said portion to be removed in the tearing direction.

25. A toner supply container according to claim 24, wherein said inclined portion is rectilinearly inclined.

26. A toner supply container according to claim 24, wherein said inclined portion is inclined with a curvature.

27. A toner supply container according to claim 24, wherein said welded portion is provided in the region where the tearing of said tearable resin film starts with a concave portion which is concave toward a downstream direction with respect to the tearing direction.

28. A toner supply to container according to claim 24, wherein said resin film further comprises an extension which extends from a tearing-starting side of said welded portion and which is folded back and extends to an end thereof, wherein said end of said extension is provided with a pulling portion.

29. A toner supply container according to claim 24, wherein said portion to be removed from said container body by tearing of said resin film is provided by using laser irradiation.

30. A toner supply container according to claim 24, further comprising a tear tape configured and positioned to remove said tearable resin film, wherein said portion to be removed from said container body by tearing of said resin film comprises said tear tape.

* * * * *

UNITED STATES PATENT AND TRADEMARK OFFICE

CERTIFICATE OF CORRECTION

PATENT NO. : 6,909,865 B2 
DATED : June 21, 2005
INVENTOR(S) : Toshiaki Nagashima et al.

It is certified that error appears in the above-identified patent and that said Letters Patent is hereby corrected as shown below:

Title page,
Item [56], References Cited, FOREIGN PATENT DOCUMENTS,
"JP 04155363 A 5/1992" should read -- JP4-155363 A 5/1992 --.
"JP 11305536 A 11/1999" should read -- JP 11-305536 A 11/1999 --.
Item [57], ABSTRACT,
Line 4, "unsealebly" should read -- unsealably --.

Column 1,
Line 62, "that balance" should read -- of balance --.

Column 2,
Line 1, "result of wider opening, upon without the toner supply" should read -- result of a wider opening, so that toner supply --.
Line 13, "during the" should read -- during --.

Column 3,
Line 47, "property" should read -- a property --.
Line 61, "other" should read -- toner --.

Column 4,
Line 9, "layer, more" should read -- layer. More --.
Line 10, "melted" should read -- which is melted --.
Line 22, "this" should read -- of this --.
Line 59, "form" should read -- from --.

Column 5,
Line 5, "condition" should read -- conditions --.
Line 15, "unsealing" should read -- the unsealing --.

Column 6,
Line 42, "modification" should read -- modification becomes necessary --.
Line 52, "the use can be made with" should read -- use can be made of --.
Line 58, "the cost" should read -- cost --.
Line 62, "test" should read -- testing --.
Line 66, "seal" should read -- the seal --.

UNITED STATES PATENT AND TRADEMARK OFFICE

CERTIFICATE OF CORRECTION

PATENT NO. : 6,909,865 B2
DATED : June 21, 2005
INVENTOR(S) : Toshiaki Nagashima et al.

It is certified that error appears in the above-identified patent and that said Letters Patent is hereby corrected as shown below:

Column 7,
Line 15, “is contacted with” should read -- and --.
Line 29, “The delamination” should read -- Delamination --.
Line 51, “rearing” should read -- tearing --.
Line 55, “also” should read -- also be --.
Line 56, “test” should read -- testing --.
Line 60, “seal” should read -- the seal --.
Line 62, “in which” should read -- concerning --.
Line 65, “foil” should read -- foil layer --.

Column 8,
Line 16, “(4a)” should read -- (4a)) --.
Line 23, “1, and” should read -- 1, which --.
Line 42, “test” should read -- testing --.
Line 63, “which” should be deleted.

Column 9,
Line 22, “guide 103c.” should read -- guide 103f. --.
Line 27, “1031” (both occurrences) should read -- 103*1* --.
Line 36, “guide 103c,” should read -- 103f, --.
Line 37, “1031” should read -- 103*l* --.

Column 10,
Line 43, “member” should read -- members --.
Line 67, “which is” should read -- which are --.

Column 11,
Line 6, “cartridge” should read -- cartridge B --.
Line 13, “test” should read -- testing--.

Column 12,
Line 8, “feeling” should read -- peeling --.

Column 14,
Line 18, “potion” should read -- portion --.

UNITED STATES PATENT AND TRADEMARK OFFICE

CERTIFICATE OF CORRECTION

PATENT NO. : 6,909,865 B2
DATED : June 21, 2005
INVENTOR(S) : Toshiaki Nagashima et al.

It is certified that error appears in the above-identified patent and that said Letters Patent is hereby corrected as shown below:

Column 15,
Line 6, “supply to” should read -- supply --.

Signed and Sealed this

Fourth Day of April, 2006

JON W. DUDAS
*Director of the United States Patent and Trademark Office*